US007208885B2

(12) United States Patent
Hsu

(10) Patent No.: US 7,208,885 B2
(45) Date of Patent: Apr. 24, 2007

(54) DIMMING CONTROL METHOD AND LIGHTING SYSTEM WITH DIMMING CONTROL

(75) Inventor: Cheng-Chia Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 189 days.

(21) Appl. No.: 10/992,022

(22) Filed: Nov. 17, 2004
(Under 37 CFR 1.47)

(65) Prior Publication Data

US 2006/0103330 A1 May 18, 2006

(30) Foreign Application Priority Data

Nov. 17, 2003 (CN) ..... 92 1 32123

(51) Int. Cl.
*H05B 41/36* (2006.01)

(52) U.S. Cl. ..... 315/291

(58) Field of Classification Search ..... 315/291, 315/307, 363, DIG. 2
See application file for complete search history.

(56) References Cited

U.S. PATENT DOCUMENTS

| | | | | |
|---|---|---|---|---|
| 6,169,376 | B1 * | 1/2001 | Greenberg et al. | 315/291 |
| 6,531,830 | B2 * | 3/2003 | Akimoto et al. | 315/224 |
| 6,720,705 | B2 * | 4/2004 | Nakatsuka et al. | 310/316.01 |
| 6,836,079 | B2 * | 12/2004 | Hong | 315/291 |
| 7,009,348 | B2 * | 3/2006 | Mogilner et al. | 315/307 |
| 2002/0060537 | A1 | 5/2002 | Lee et al. | |
| 2005/0156534 | A1 * | 7/2005 | Oh | 315/247 |

* cited by examiner

*Primary Examiner*—Shih-Chao Chen
*Assistant Examiner*—Minh Dieu A
(74) *Attorney, Agent, or Firm*—Wei Te Chung

(57) ABSTRACT

A dimming control method and a lighting system having dimming control, in which the lighting system (200) includes an input unit (210), a light-emission unit (260) and a current control circuit (220). The dimming control method is characterized by outputting a continuous current with a varying amplitude to the light-emission unit under a higher brightness, and clamping the amplitude of the current output to the light-emission unit to a fixed value and outputting a discontinuous current with a fixed amplitude and a varying duty cycle to the light-emission unit under a lower brightness.

16 Claims, 4 Drawing Sheets

DIMMING CONTROL METHOD AND LIGHTING SYSTEM WITH DIMMING CONTROL

BACKGROUND OF THE INVENTION

1. Field of the Invention

The invention relates to dimming control methods and lighting systems incorporating dimming control; and more particularly to a dimming control method combining a continuous dimming control technique and a burst dimming control technique, and a lighting system employing this kind of dimming control method.

2. Background of the Invention

The improved quality and reduced costs of modern Liquid Crystal Displays (LCDs) are making the LCD an increasingly popular choice in the field of display devices. LCDs are traditionally employed in notebook computers and other portable computer systems. LCD devices have made progress in conjunction with the evolution of computer displays from the conventional Video Graphics Array (VGA) standard to the newer Extended Graphics Array (XGA) standard. Nowadays, LCD devices have a superior display quality to that of Cathode Ray Tubes (CRTs), and are poised to replace conventional CRT devices.

The LCD cannot achieve light-emission independently—it has to rely on a backlight source. The backlight source and relevant elements are indispensable in the direct-viewing type of LCD device. The performance of the backlight source significantly influences the display quality of the LCD device. Moreover, the backlight source is a large contributor to the cost and power consumption of the LCD device.

Dimming control of the backlight source is nowadays performed by way of either of two techniques; namely, a continuous dimming control technique or a burst dimming control technique. In the continuous dimming control technique, an amplitude of a current output to a light-emission unit is adjustable according to a change of brightness of the light-emission unit, and the output current is a continuous wave.

FIG. 4 is a graph showing a relation between the amplitude of the current output to the light-emission unit and the brightness of the light-emission unit in the continuous dimming control technique according to a typical prior art dimming control method. The horizontal abscissa represents the brightness of the light-emission unit, and the vertical ordinate represents the amplitude of the current output to the light-emission unit. $A_{max}$ is the amplitude of a maximum current output to the light-emission unit, and $A_{max}$ corresponds to a maximum brightness $B_{max}$ of the light-emission unit. $A_0$ is a leakage current, and may occur when the current is input to the light-emission unit. When the amplitude of the current output to the light-emission unit is diminished to the value of $A_0$, the light-emission unit has no current flowing therethrough if the leakage current $A_0$ is fully taken into account. Thus, one end of the light-emission unit may emit light while the other end may not emit light. In order to maintain the lighting quality of the light-emission unit, generally the backlight source may be set with a lower-limit amplitude of the current $A_{min}$ which is higher than the leakage current $A_0$, while the brightness of the light-emission unit is set as a predetermined minimum brightness $B_{min}$ of the light-emission unit. Thus the leakage current $A_0$ is a main drawback of the continuous dimming control technique, because it can result in the current output to the light-emission unit being insufficient. In addition, the brightness of the light-emission unit may also be insufficient.

In the burst dimming control technique, the brightness of the light-emission unit is adjusted by discontinuously activating the light-emission unit. That is, a current of fixed amplitude can be output to the light-emission unit, but a duty cycle of the current output to the light-emission unit is adjusted according to variations in the brightness of the light-emission unit. When the brightness of the light-emission unit is high, the duty cycle of the current output to the light-emission unit is adjusted to be high (the highest value is 1). On the other hand, when the brightness of the light-emission unit is low, the duty cycle of the current output to the light-emission unit is adjusted to be low.

In contrast to the continuous dimming control technique, the burst dimming control technique is better insofar as the leakage current can be eliminated by fixing the amplitude of the current output to the light-emission unit. Even if the duty cycle of the current output to the light-emission unit is adjusted to an extremely small value, that is the average current is very low, the light-emission unit can still emit light uniformly. In the burst dimming control technique, because an average current ratio output to the light-emission unit is higher than that in the continuous dimming control technique, the brightness of the light-emission unit is sufficient. However, in the burst dimming control technique, the light-emission unit is discontinuously activated so that the backlight source has a higher noise than the continuous dimming control technique. If a relatively low quality power source is employed in the LCD device in order to reduce costs, this itself may lead to higher noise of the backlight source. In such case, the relatively high noise inherent in the burst dimming control technique may render this technique unsatisfactory.

SUMMARY OF THE INVENTION

A first objective of the invention is to provide a dimming control method that combines a continuous dimming control technique and a burst dimming control technique.

A second objective of the invention is to provide a system in which the above-described dimming control method can be employed.

According to the present invention, the dimming control method comprises the steps of: (a) when a brightness of a light-emission unit varies from a first value higher than a first predetermined value to a second value higher than the first predetermined value, adjusting an amplitude of a current output to the light-emission unit and outputting a current having an amplitude corresponding to the second value to the light-emission unit; (b) when the brightness of the light-emission unit varies from a third value lower than a second predetermined value to a fourth value lower than the second predetermined value, adjusting a duty cycle of the current output to the light-emission unit and outputting a current having a duty cycle corresponding to the fourth value to the light-emission unit; (c) when the brightness of the light-emission unit varies from a fifth value higher than the second predetermined value to a sixth value lower than the second predetermined value, fixing the amplitude of the current output to the light-emission unit at a third predetermined value, adjusting the duty cycle of the current output to the light-emission unit, and outputting a current having a duty cycle corresponding to the sixth value to the light-emission unit; and (d) when the brightness of the light-emission unit varies from a seventh value lower than the first predetermined value to an eighth value higher than the first predetermined value, fixing a duty cycle of the current output to the light-emission unit at a fourth predetermined value, adjusting the amplitude of the current output to the light-emission unit, and outputting a current having an amplitude corresponding to the eighth value to the light-emission unit.

According to the present invention, the lighting system comprises: an input unit for generating an intensity control signal; a light-emission unit comprising at least one fluorescent lamp set; and a current control unit electrically connected to the input unit and the light-emission unit for outputting a current to the light-emission unit according to the intensity control signal. The current control unit comprises a digital controller for controlling a duty cycle of the current output to the light-emission unit, and an analog controller. The analog controller comprises: a current amplitude control circuit for controlling amplitude of the current output to the light-emission unit, and a clamping circuit for keeping the amplitude of the current output to the light-emission unit not lower than a predetermined value.

Other objects, advantages and novel features of the present invention will be drawn from the following detailed description of a preferred method and embodiments of the present invention with the attached drawings, in which:

DETAILED DESCRIPTION OF PREFERRED EMBODIMENTS OF THE INVENTION

Figure 1:
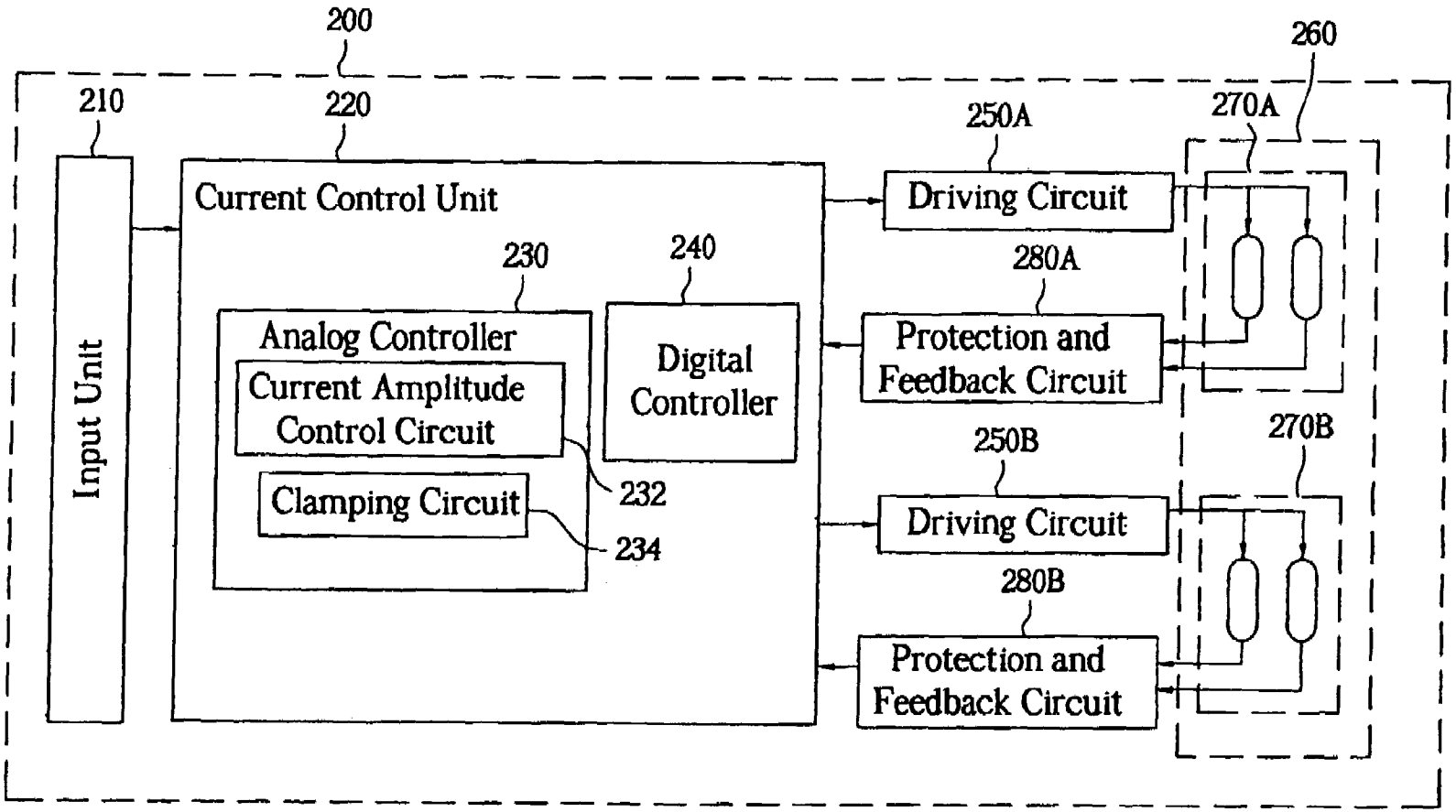
FIG. 1 is a schematic diagram of a lighting system with dimming control according to the present invention.

FIG. 1 is a schematic diagram of a lighting system 200 with dimming control according to the present invention. In the preferred embodiment, the lighting system 200 comprises an input unit 210 for generating an intensity control signal, a light-emission unit 260 including two fluorescent lamp sets 270A and 270B, and a current control unit 220 that is electrically connected to the input unit 210 and the light-emission unit 260, for controlling an amplitude and a duty cycle of the output current according to an intensity control signal (such as a lighting intensity control signal) received from the input unit 210. The current control unit 220 comprises a digital controller 240 for controlling the duty cycle of the output current, and an analog controller 230. The analog controller 230 includes a current amplitude control circuit 232 for controlling the amplitude of the output current, and a clamping circuit 234 for keeping the amplitude of the output current not lower than a predetermined value. The clamping circuit 234 is a voltage-limiting circuit implemented by a diode or other circuits. In addition, the input unit 210 inputs a DC current to the current control unit 220, and the current control unit 220 changes the DC current to an AC current and outputs the AC current to the light-emission unit 260. In the exemplary embodiment, the lighting system 200 further includes two driving circuits 250A and 250B, and two protection and feedback circuits 280A and 280B. Accordingly, the driving circuits 250A and 250B respectively drive the fluorescent lamp sets 270A and 270B with the AC current. Further, the fluorescent lamp sets 270A and 270B are respectively electrically connected to the protection and feedback circuits 280A and 280B for providing feedback information to the current control unit 220.

Figure 2:
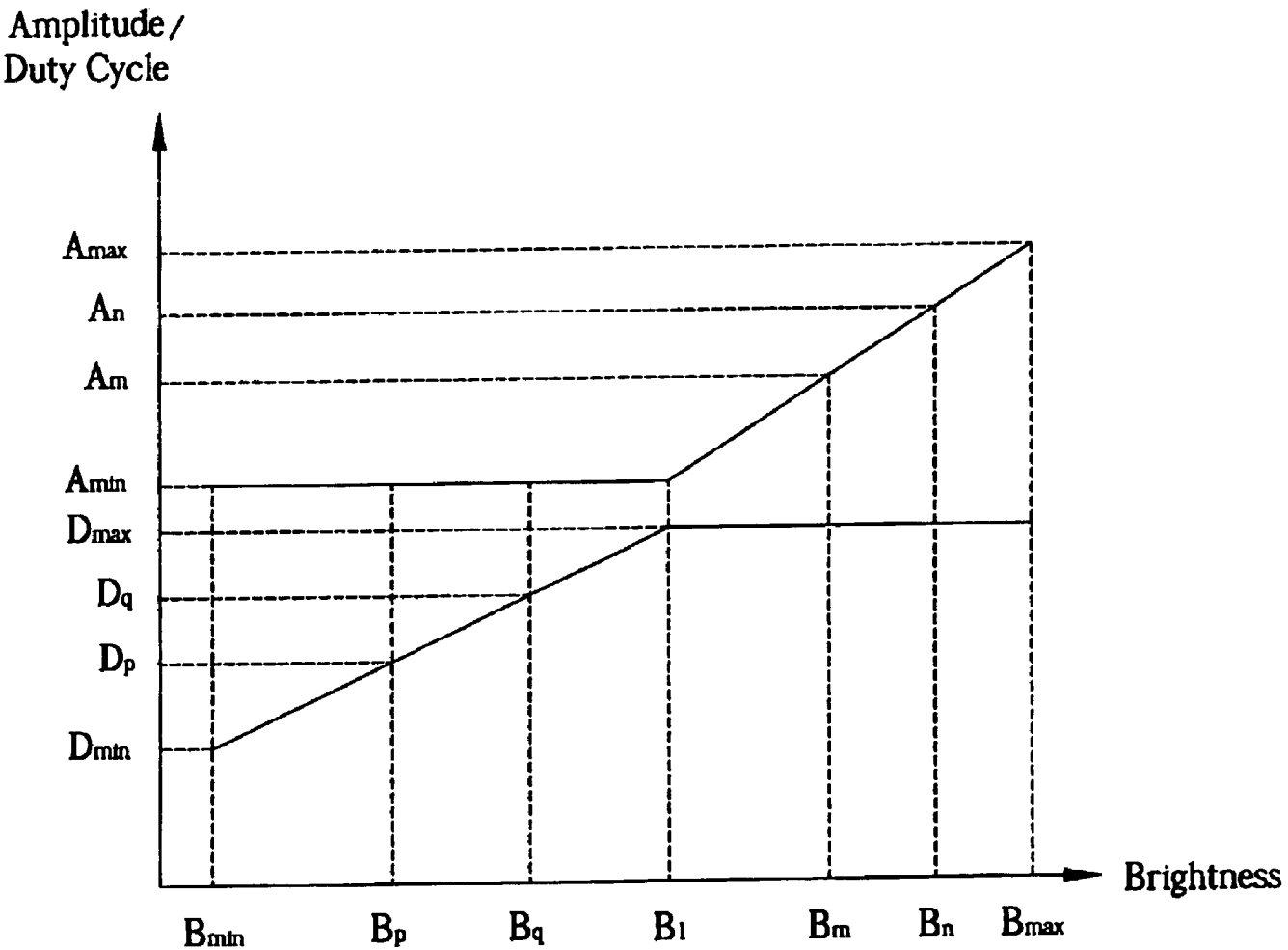
FIG. 2 is a graph of a relation between an amplitude and a duty cycle of the current output to a light-emission unit and brightness of the light-emission unit according to a first embodiment of the present invention.

FIG. 2 is a graph showing a relation between (i) the amplitude and the duty cycle of the current output to the light-emission unit 260 and (ii) the brightness of the light-emission unit 260, according to a first embodiment of the present invention. The horizontal abscissa represents the brightness of the light-emission unit 260, while the vertical ordinate represents the amplitude and the duty cycle of the current output to the light-emission unit 260. According to the present invention, when the lighting system 200 provides a higher brightness, the current control unit 220 controls the amplitude of the current output to the light-emission unit 260 to adjust the brightness of the light-emission unit 260 by using a continuous dimming control technique. On the other hand, when the lighting system 200 provides a lower brightness, the amplitude of the current output to the light-emission unit 260 is fixed while the current control unit 220 controls the duty cycle of the current output to the light-emission unit 260 in order to adjust the brightness of the light-emission unit 260 by using a burst dimming control technique.

For instance, when the lighting system 200 provides a brightness higher than a value $B_1$ as shown in FIG. 2, the brightness is adjusted by controlling the amplitude of the current output to the light-emission unit 260. That is, the duty cycle of the current is fixed at $D_{max}$ ($D_{max}$ is 1 in the preferred embodiment). When the lighting system 200 provides a brightness lower than the value $B_1$, the amplitude of the current output to the light-emission unit 260 is fixed at $A_{min}$, while the brightness is adjusted by adjusting the duty cycle of the current output to the light-emission unit 260. That is, the duty cycle of the current can be changed to a value between $D_{max}$ and $D_{min}$. Referring also to FIG. 1, when the brightness is required to be varied from $B_m$ to $B_n$, the input unit 210 generates an intensity control signal to be transmitted to the current control unit 220. When both $B_m$ and $B_n$ are higher than $B_1$, the digital controller 240 keeps the duty cycle of the output current at 1, while the current amplitude control circuit 232 of the analog controller 230 can adjust the amplitude of the output current from $A_m$ (corresponding to $B_m$) to $A_n$ (corresponding to $B_n$). When the brightness is required to be varied from $B_n$ to $B_p$ ($B_p$ is lower than $B_1$), the intensity control signal generated by the input unit 210 adjusts the duty cycle of the output current, which is controlled by the digital controller 240, from 1 to $D_p$ (corresponding to the brightness $B_p$). The clamping circuit 234 of the analog controller 230 fixes the amplitude of the output current at $A_{min}$. When the brightness is adjusted from $B_p$ to $B_q$ ($B_q$ is also lower than $B_1$), the clamping circuit 234 fixes the amplitude of the output current at $A_{min}$ while the digital controller 240 adjusts the duty cycle of the output current from $D_p$ (corresponding to the brightness $B_p$) to $D_q$ (corresponding to the brightness $B_q$). When the brightness is to be varied from $B_q$ to $B_1$ ($B_n$ is higher than $B_1$), the intensity control signal generated by the input unit 210 adjusts the duty cycle of the output current from $D_q$ (corresponding to the brightness $B_q$) to $D_{max}$, while the current amplitude control circuit 232 of the anolog controller 230 adjusts the amplitude of the output current from $A_{min}$ to $A_n$ (corresponding to $B_n$).

Figure 3:
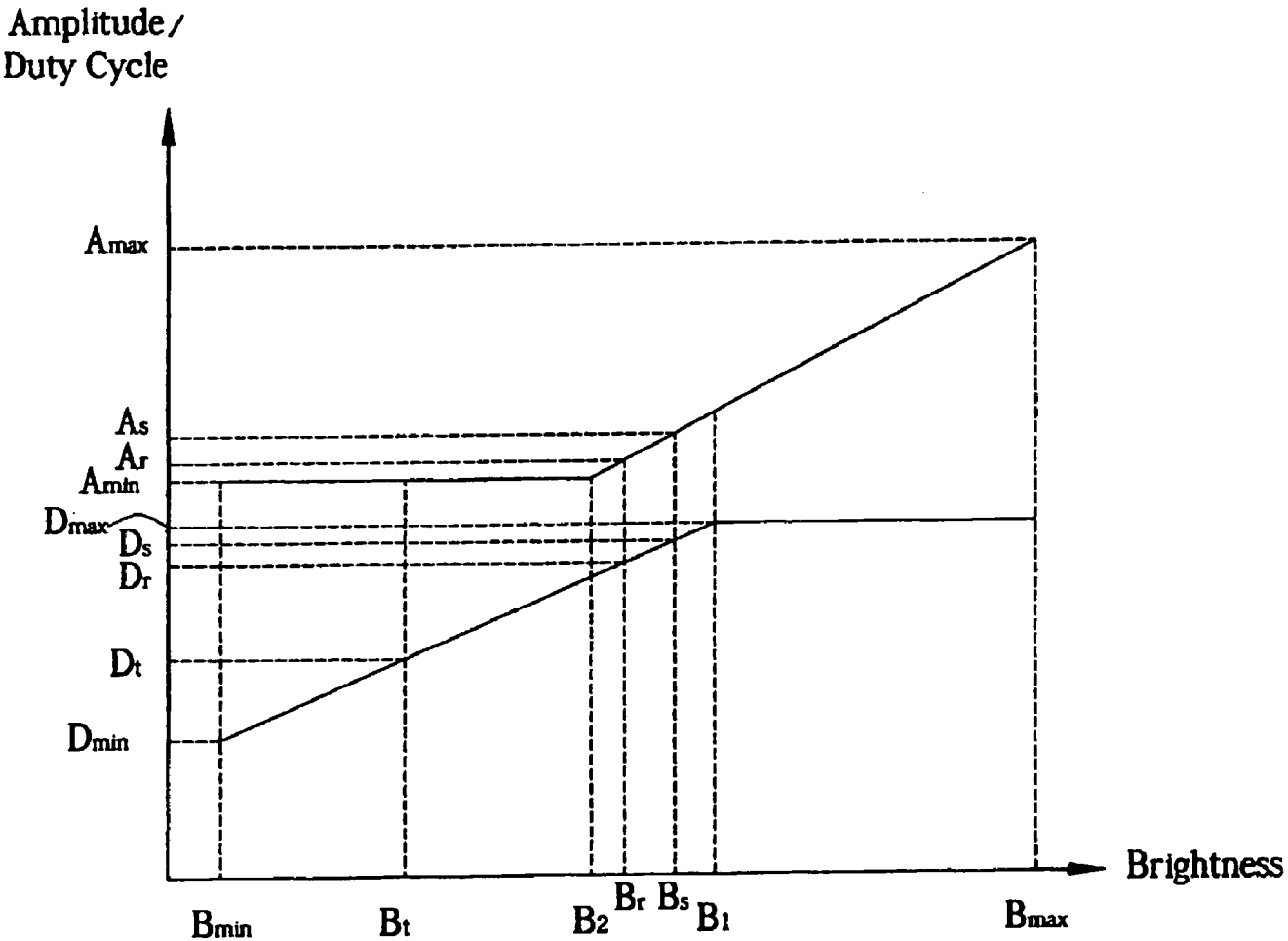
FIG. 3 is a graph of a relation between the amplitude and the duty cycle of the current output to the light-emission unit and the brightness of the light-emission unit according to a second embodiment of the present invention.
Figure 4:
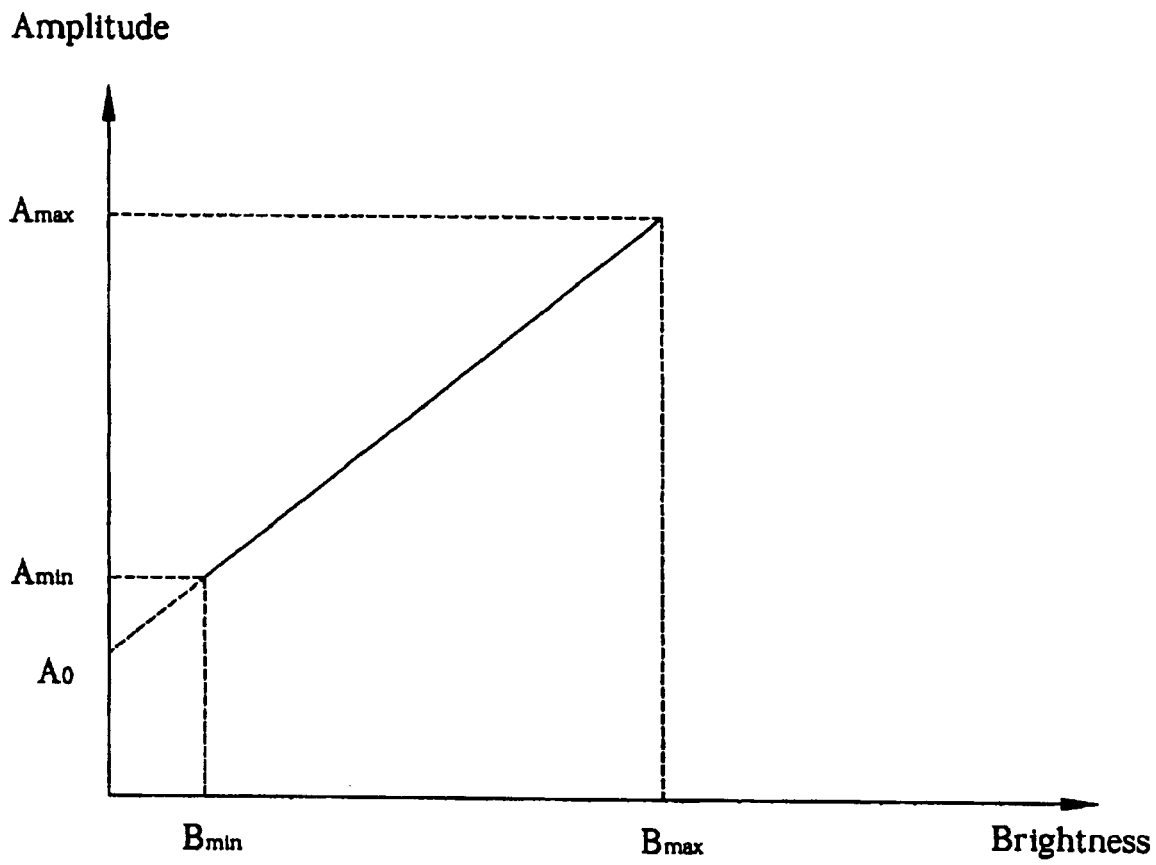
FIG. 4 (PRIOR ART)
FIG. 4 is a graph of a relation between the amplitude of a current output to a light-emission unit and the brightness of the light-emission unit in a continuous dimming control technique according to the prior art.

According to the present invention, two brightness values ($B_1$ and $B_2$ in FIG. 3), which respectively correspond to the amplitude of the current (output to the light-emission unit 260) varying from a value higher than the minimum amplitude $A_{min}$ to the minimum amplitude $A_{min}$ and the duty cycle of the current (output to the light-emission unit 260) varying from a value lower than 1 to 1, can be different. That is, a luminescent section may be set in which the brightness may vary with the amplitude and the duty cycle of the current at the same time. FIG. 3 is a graph showing the relation between the amplitude and the duty cycle of the current and the brightness (output to the light-emission unit 260), according to a second embodiment of the present invention. The horizontal abscissa represents the brightness of the light-emission unit 260, while the vertical ordinate represents the amplitude and the duty cycle of the current output to the light-emission unit 260.

In FIG. 2 and FIG. 3, when the brightness is higher than $B_1$, the duty cycle of the current is fixed at $D_{max}$. However, in the second embodiment shown in FIG. 3, when the brightness is lower than $B_2$, the amplitude of the current is fixed at $A_{min}$, and $B_2$ is not equal to $B_1$. For instance, when the brightness is to be varied from $B_t$ ($B_t$ is lower than $B_1$ and $B_2$) to $B_r$ ($B_r$ is between $B_2$ and $B_1$), the intensity control signal generated by the input unit 210 is transmitted to the current control unit 220, and then the digital controller 240 adjusts the duty cycle of the output current from $D_t$ (corresponding to the brightness $B_t$) to $D_r$ (corresponding to the brightness $B_r$). Simultaneously, the current amplitude control circuit 232 of the analog controller 230 adjusts the amplitude of the output current from $A_{min}$ to $A_r$ (corresponding to $B_r$). When the brightness is adjusted from $B_r$ to $B_s$ ($B_s$ is also between $B_2$ and $B_1$), the intensity control signal generated by the input unit 210 can be used to adjust the duty cycle of the output current from $D_r$ (corresponding to the brightness $B_r$) to $D_s$ (corresponding to the brightness $B_s$). Simultaneously, the current control circuit 232 of the analog controller 230 adjusts the amplitude of the output current from $A_r$ (corresponding to the brightness $B_r$) to $A_s$ (corresponding to the brightness $B_s$). Therefore, when the brightness varies between $B_2$ and $B_1$, the digital controller 240 and the analog controller 230 simultaneously change the duty cycle and the amplitude of the current corresponding to the brightness. According to the present invention, the range of brightness (between $B_2$ and $B_1$) can be changed according to practical requirements so that the brightness ratio of the light-emission unit 260 can be sufficient and so that noises are significantly reduced.

The light-emission unit 260 of the lighting system 200 comprises two fluorescent lamp sets 270A and 270B. When the fluorescent lamp sets 270A and 270B are respectively driven and controlled by different driving circuits and when the light-emission unit 260 is operated with a low brightness, discontinuous currents with various phases are output to the different fluorescent lamp sets 270A and 270B to further reduce the noises generated by the light-emission unit 260. In FIG. 1, the lighting system 200 comprises two fluorescent lamp sets 270A and 270B respectively driven by the driving circuits 250A and 250B. When the brightness provided by the lighting system 200 is $B_p$ ($B_p$ is lower than the brightness $B_1$—see FIG. 2), the current control unit 220 controls the driving circuits 250A and 250B to transmit the current with the amplitude of $A_{min}$ to the fluorescent lamp sets 270A and 270B. The duty cycle of the current is $D_p$ (corresponding to $B_p$). The currents respectively input to the fluorescent lamp sets 270A and 270B have a 180° phase difference and are discontinuous currents with the same duty cycle $D_p$. Thus, reduced variation of the output current of the lighting system 200 leads to lower noise.

In summary, according to the present invention, the dimming control method combines the continuous dimming control technique and the burst dimming control technique. The lighting system 200 can implement the dimming control method. When a high brightness is provided, the continuous dimming control technique is used to adjust the brightness by controlling the amplitude of the current output to the light-emission unit 260. When a low brightness is provided, the clamping circuit 234 fixes the amplitude of the current output to the light-emission unit 260 while the duty cycle of the current is adjusted by using the burst dimming control technique. According to the present invention, when a higher brightness is provided, a continuous current is output instead of a discontinuous current whose duty cycle is lower than 1, in order to reduce the noises generated by the lighting system 200. On the other hand, when a lower brightness is provided, the duty cycle of the current is adjusted to increase the average output current ratio of the lighting system 200. In addition, the phase difference can be set among the currents respectively input to the two fluorescent lamp sets 270A and 270B, in order to further reduce noises. The amplitude of the current is fixed at a value not lower than a predetermined value in order to restrain the leakage current, and then the light-emission unit 260 can provide uniform light emission. Furthermore, the dimming control method of the present invention can be applied in a backlight source installed with cold cathode tubes or in other kinds of light-emission devices that are used in LCD devices.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dimming control method, the method implemented in a lighting system comprising an input unit for generating an intensity control signal and a light-emission unit, the method comprising the steps of:

(a) when the intensity control signal varies from a first value higher than a first predetermined value to a second value higher than the first predetermined value, adjusting an amplitude of a current output to the light-emission unit and outputting a current having an amplitude corresponding to the second value;

(b) when the intensity control signal varies from a third value lower than a second predetermined value to a fourth value lower than the second predetermined value, adjusting a duty cycle of the current output to the light-emission unit and outputting a current having a duty cycle corresponding to the fourth value;

(c) when the intensity control signal varies from a fifth value higher than the second predetermined value to a sixth value lower than the second predetermined value, fixing the amplitude of the current output to the light-emission unit at a third predetermined value, adjusting the duty cycle of the current output to the light-emission unit, and outputting a current having a duty cycle corresponding to the sixth value; and (d) when the intensity control signal varies from a seventh value lower than the first predetermined value to an eighth value higher than the first predetermined value, fixing the duty cycle of the current output to the light-emission unit at a fourth predetermined value, adjusting the amplitude of the current output to the light-emission unit, and outputting a current having an amplitude corresponding to the eighth value.

2. The dimming control method as claimed in claim 1, further comprising the following step:

(e) when the intensity control signal varies from a ninth value to a tenth value which is lower than the first predetermined value and higher than the second predetermined value, adjusting the amplitude and the duty cycle of the current output to the light-emission unit and outputting a current having an amplitude and a duty cycle corresponding to the tenth value;

wherein the first predetermined value is higher than the second predetermined value.

3. The dimming control method as claimed in claim 2, wherein the light-emission unit comprises a plurality of fluorescent lamp sets, and in step (e), at least one phase difference exists among currents respectively input to the plurality of fluorescent lamp sets.

4. The dimming control method as claimed in claim 2, wherein in step (e), the discontinuous AC current is output to the light-emission unit.

5. The dimming control method as claimed in claim 1, wherein the fourth predetermined value is 1.

6. The dimming control method as claimed in claim 1, wherein the light-emission unit comprises a plurality of fluorescent lamp sets, and in step (b,) or step (c), at least one phase difference exists among currents respectively input to the plurality of fluorescent lamp sets.

7. The dimming control method as claimed in claim 1, wherein in step (a) or step (d), a continuous AC current is output to the light-emission unit.

8. The dimming control method as claimed in claim 1, wherein in step (b) or step (c), a discontinuous AC current is output to the light-emission unit.

9. A lighting system comprising:

an input unit for generating a lighting intensity control signal;

a light-emission unit comprising at least one fluorescent lamp set; and a current control unit electrically connected to the input unit and the light-emission unit for outputting current to the light-emission unit according to the lighting intensity control signal, the current control unit comprising:

an analog controller comprising:

a current amplitude control circuit for controlling an amplitude of the current output to the light-emission unit; and a clamping circuit for keeping the amplitude of the current output to the light-emission unit not lower than a predetermined value; and a digital controller for controlling a duty cycle of the current output to the light-emission unit.

10. The lighting system as claimed in claim 9, further comprising a protection and feedback unit electrically connected between the light-emission unit and the current control unit for providing feedback information to the current control unit, wherein the current control unit is configured for outputting the current to the light-emission unit according to the feedback information.

11. The lighting system as claimed in claim 9, wherein the at least one fluorescent lamp set is a plurality of fluorescent lamp sets, and the digital controller is used for setting at least one phase difference among the currents input to the plurality of fluorescent lamp sets.

12. The lighting system as claimed in claim 9, wherein the input unit is used for inputting a DC current to the current control unit, and the current control unit is used for setting the current output to the light-emission unit as an AC current.

13. The lighting system as claimed in claim 9, wherein the current control unit is used for outputting the AC current to the light-emission unit.

14. A lighting system comprising:

an input unit for generating a lighting intensity control signal;

a light-emission unit for illumination; and a current control unit electrically connected to the input unit and the light-emission unit for outputting current to the light-emission unit according to the lighting intensity control signal, the current control unit comprising:

an analog controller comprising:

means for controlling an amplitude of the current output to the light-emission unit; and means for keeping the amplitude of the current output to the light-emission unit not lower than a predetermined value; and means for controlling a duty cycle of the current output to the light-emission unit.

15. The system as claimed in claim 14, wherein the amplitude of the current output of the light-emission unit is not of a liner pattern relative to a brightness thereof.

16. The system as claimed in claim 14, wherein the duty cycle of the current output of the light-emission unit is of a linear pattern relative to a brightness thereof.

* * * * *